US005785511A

United States Patent [19]

Shah

[11] Patent Number: 5,785,511

[45] Date of Patent: Jul. 28, 1998

[54] CONTROL DEVICE FOR GAS SUPPLY TO MAIN BURNER AND PILOT BURNER OF A GAS EQUIPMENT

[76] Inventor: Reza H. Shah, 21 Park Avenue, Acton, Ontario, Canada, L7J 1Y3

[21] Appl. No.: 675,864

[22] Filed: Jul. 5, 1996

[51] Int. Cl.[6] ..... F23Q 9/08

[52] U.S. Cl. ..... 431/42; 431/46; 431/54; 431/58; 137/65; 251/229

[58] Field of Search ..... 431/42, 56, 46, 431/59, 48, 51, 52, 53, 54, 61; 137/65, 66; 251/229, 231, 242, 247, 284

[56] References Cited

U.S. PATENT DOCUMENTS

| | | | |
|---|---|---|---|
| 4,087,231 | 5/1978 | Matthews | 431/59 |
| 4,111,640 | 9/1978 | Scott | 431/46 |
| 4,346,835 | 8/1982 | Trotter et al. | 431/255 |
| 4,413,975 | 11/1983 | Turner et al. | 431/56 |
| 4,971,095 | 11/1990 | Kelly et al. | 137/66 |

*Primary Examiner*—Larry Jones
*Attorney, Agent, or Firm*—David W. Wong

[57] ABSTRACT

In this combustion gas control device, an electromechanical control is provided for automatically controlling the supply of the gas to the pilot burner when it is being ignited and subsequently to the main burner. The device has a main chamber, a pilot chamber and an outlet chamber. A spring-biassed valve is provided between the main chamber and the pilot chamber to close communication between the main chamber and pilot and outlet chambers. The spring-biassed valve is opened when a solenoid is actuated to allow gas from the main chamber to flow into the pilot chamber to the pilot outlet for lighting the pilot light. A diaphragm cover is provided between the pilot chamber and outlet chamber while the pilot is lighted to prevent gas from entering the outlet chamber. After the pilot has been lighted the spring-biassed valve is maintained opened by an electromagnetic mechanism while the solenoid is de-energized so as to open the diaphragm cover whereby gas flows to the pilot light as well as the outlet of the device to the burner.

20 Claims, 3 Drawing Sheets

CONTROL DEVICE FOR GAS SUPPLY TO MAIN BURNER AND PILOT BURNER OF A GAS EQUIPMENT

BACKGROUND OF THE INVENTION

This invention relates to a combustion gas control valve and particularly to a natural gas control device for automatically controlling the flow of the combustion gas to the pilot burner and the main burner. The device may be actuated remotely to initiate the pilot burner and to supply the gas to the main burner in the normal operation.

In a combustion gas burner system commonly it has a pilot burner which maintains a pilot flame that provides the means to ignite the gas at the main burner during normal operation. In starting the system, in order to initiate the pilot flame, the gas must be supplied to the pilot burner only without any gas passing to the main burner so that pilot burner can be lighted. Such operation is commonly provided by a manually operated mechanical control valve having a rotary cock which may be turned to three separate settings: OFF; PILOT and ON. At the OFF setting, the valve prevents any gas from passing through the valve to either the main or pilot burner. At the PILOT setting, the gas is permitted to flow to the pilot burner only such that the pilot flame may be lighted; and at the ON setting, the gas flows through the valve to both the main and pilot burners. Such mechanical valve requires the operator to be physically located near the valve for performing all the adjustments as well as for igniting the pilot flame at the same time; its operations are therefore not convenient to carry out. Furthermore, some operators are fearful in carrying out the adjustments in closed proximity of the valve because of the potential hazard in case of a gas leak at the valve due to its malfunction.

SUMMARY OF THE INVENTION

It is a principal object of the present invention to provide a gas control device which can be operated remotely therefrom.

It is another object of the present invention to provide a gas control device which may be operated with simple switching means.

It is another object of the present invention to provide a gas control device which has a relatively simple construction and yet operates positively to control the gas flow to the pilot burner and the main burner.

Briefly, the control valve comprises a unit body having a main chamber, a pilot chamber, and an outlet chamber. The main chamber has an inlet port which is operative to admit the combustion gas into the device. The pilot chamber has a pilot outlet port operative to supply the gas to the pilot burner. The outlet chamber has a main outlet port operative to supply the gas to the main burner. A passage opening is located between the pilot chamber and the main chamber. A sealing plate member is mounted on a retaining pin which is located in the main chamber. The sealing plate member is biassed by a spring means to press normally against the passage opening so as to close the latter. A magnetic plate member is mounted on another end of the retaining pin. A magnetic core member is disposed in the main chamber. The magnetic core member has electrical windings provided thereon in which the electrical windings are electrically connected to a thermocouple located at the pilot burner. The magnetic plate member is normally located in a spaced manner from the magnetic core member. A sealing diaphragm member is located in the outlet chamber, which is operative to close communication between the pilot chamber and the outlet chamber. A solenoid means is disposed on the unit body. The solenoid means has a plunger member slidably mounted therein. The solenoid means is operative to move the plunger member slidably to an upper position and a lower position selectively within the solenoid means. A spacer member is coupled to the plunger member. The spacer member has a free end extending into the outlet chamber. The sealing diaphragm member is mounted on the spacer member. A pilot gas passage is formed in the unit body. The pilot gas passage extends from the pilot chamber to the pilot outlet port. An adjustment bolt member is disposed in the unit body. The adjustment bolt member has a transverse through opening formed therein, and the adjustment bolt member may be operated to align the transverse through opening selectively with the pilot gas passage to allow gas in the pilot chamber to flow therethrough to the pilot outlet port.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
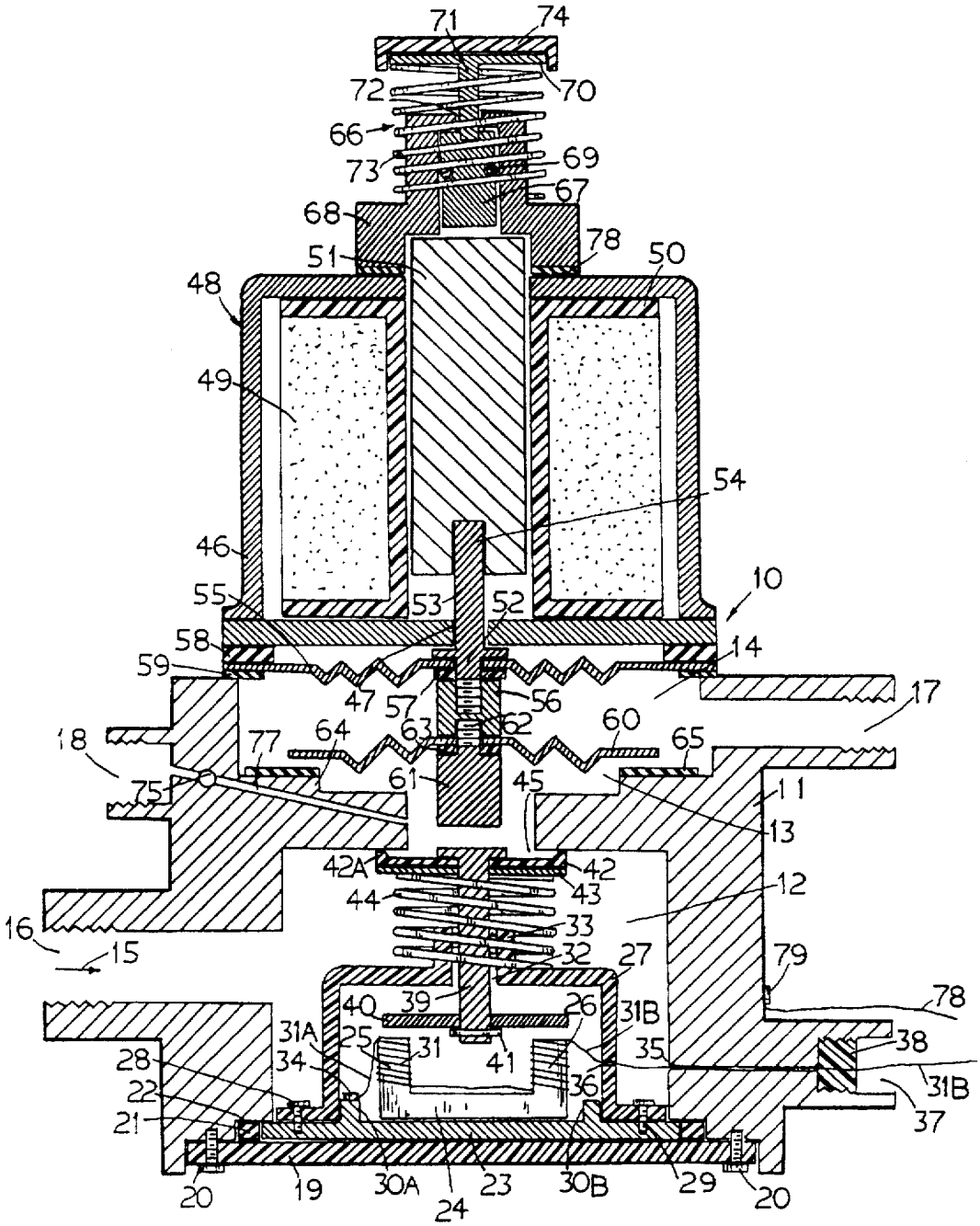
FIG. 1 is a general partial cross sectional side elevation view of the control valve in the OFF condition according to the present invention.

With reference to the drawings wherein like reference numerals designate the corresponding parts in the several views, the control device 10 of the present invention has a unit body 11 which may be made with cast metal or plastic. The device is suitable for controlling the gas supply to the burner of equipment such as a natural or propane gas furnace, fireplace, or barbecue unit having a pilot burner and a main burner. The pilot burner may be lighted by electronic or mechanical means or manually with a lighted match. The control device 10 generally has a main chamber 12, a pilot chamber 13, and an outlet chamber 14. A gas supply 15 is admitted into the main chamber 12 through an inlet port 16. A main outlet port 17 is provided to supply the gas to the main burner; and a pilot outlet port 18 is provided to supply the gas to the pilot burner. The control device 10 has a bottom opening which is covered with a bottom cover 19 secured to the unit body 11 with at least two screws 20. The bottom cover 19 may be made of plastic or non-magnetizable metal. A sealing gasket or o-ring 21 made of rubber or similar material is provided at a shoulder portion 22 of the bottom opening between the bottom cover 19 and the unit body 11 to ensure a tight seal of the bottom opening.

A support plate 23 made of a non-magnetizable metal may be secured at the bottom opening of the unit body 11 and held in place at the shoulder portion 22 between the bottom cover 19 and the unit body 11. A U-shaped magnetic core 24 is mounted on the support plate 23. The magnetic core 24 as shown preferably has a U-shape having two upstanding arms 25 and 26, and it is made of a magnetizable material such as ferrite and it has two upstanding arms 25 and 26; however, it may have other shapes such as a single cylindrical column. The magnetic core 24 is enclosed within a plastic cover 27 which may be secured to the support plate 23 with screws 28 and 29. The plastic cover 27 is positioned properly in place by engaging in abutment with either two upstanding posts 30A and 31B or an upstanding ridge of which 30A and 31B are the cross section of its two opposite sides formed on the support plate 23. A winding 31 of a thermocouple wire is wound on the two upstanding arms 25 and 26 of the U-shaped magnetic core 24. One lead 31A of the winding 31 is connected by a securing screw 34 to the post or ridge 30A of the support plate 23 which has an intimate electrical contact with the unit body 11 by the tight securement of the bottom cover 19 to the unit body 11. The other lead 31B of the thermocouple winding 31 extends through a side opening 36 of the plastic cover 27 and an opening 35 through the side of the unit body 11 to the side connection port 37 for connection to the thermocouple located at the pilot burner. The side connection port 37 is sealed with a sealing plug 38 to prevent any gas from leaking therethrough from the main chamber 12. The plastic cover 27 has a central top opening 32 defined by an upstanding top sleeve portion 33. A control valve is mounted to the top opening 32 of the plastic cover 27. The control valve assembly consists of a T-shaped pin 39 having a lower end located within the plastic cover 27. A magnetic plate 40 is mounted at the lower end of the T-shaped pin 39 by a slip ring 41. The magnetic plate 40 is normally located in a space manner above the top of the upstanding arms 25 and 26 of the U-shaped magnetic core 24. A sealing plate 42 is mounted at the top end of the T-shaped pin 39. The sealing plate 42 may be made of rubber, plastic or similar material and preferably has an upstanding annular ridge 42A. A metal backing plate 43 is provided underneath the sealing plate 42 to support the latter, and a compression coil spring 44 is located between the top of the plastic cover 27 and the backing plate 43 such that the compression coil spring 44 normally maintains the sealing plate 42 to press tightly upwards to close the passage opening 45 between the main chamber 12 and the pilot chamber 13. The upstanding annular ridge 42A enhances the air-tight closing of the passage opening 45.

The outlet chamber 14 is covered with a top cover 46 which has a central opening 47. A solenoid 48 is mounted on top of the top cover 46. The solenoid 48 includes electromagnetic windings 49 wound on a bobbin 50, and a central plunger 51 is slidably located in the center of the bobbin 50. A cross-shaped spacer 52 is located in the outlet chamber 14 and the upper leg portion 53 slidably extending through the central opening 47 of the top cover 46 is mounted to the bottom of the plunger 51 such as by tight fitting 54 or threading provided therein. A spring diaphragm 55 is mounted to the lower end of the cross-shaped spacer 52 with a coupling sleeve 56 which may also be mounted to the lower end portion of the cross-shaped spacer 52 such as by threading provided therein. An annular washer 57 is provided between the coupling sleeve 56 and the cross-shaped spacer 52 to enhance the securement of the spring diaphragm 55 thereto. The rim of the spring diaphragm 55 is secured between the top of the outlet chamber 14 and the top cover 46. The rim of the spring diaphragm 55 is sandwiched between an upper annular sealing gasket 58 and a lower annular sealing gasket 59 to ensure an air tight seal of the mounting. A cover diaphragm 60 is mounted to the lower end of the coupling sleeve 56 with an extender member 61 which may have a threaded upper end portion 62 threadingly mounted to the coupling sleeve 56. A washer 63 may be provided between the extender member 61 and the coupling sleeve 56 to maintain the securement of the cover diaphragm 60 thereon. A stepped shoulder 64 is formed at the top of the pilot chamber 13. The diameter of the stepped shoulder 64 is smaller than the diameter of the cover diaphragm 60 such that when the cover diaphragm 60 is located at a lower position, the pilot chamber 13 is covered by the rim portion of the cover diaphragm 60 pressing against the stepped shoulder 64. An annular sealing gasket 65 is provided on the stepped shoulder 64 to enhance the air tight engagement between the rim portion of the cover diaphragm 60 and the stepped shoulder 64.

A manual over-ride 66 is mounted on top of the solenoid 48, which consists of a movable shaft 67 slidably mounted within an enclosure 68. An o-ring 69 is mounted on a groove provided on the shaft 67 to form an intimate seal between the shaft 67 and the internal side wall of the enclosure 68 to prevent any combustion gas in the control device from escaping through the manual over-ride 66. The shaft 67 is movable slidably within the enclosure 68 by operating a T-shaped actuating button 70 which has a vertical arm 71 extending through a top opening 72 in the enclosure 68 and is mounted to the top of the shaft 67. The T-shaped actuating button 70 is normally biassed at the raised top position by a compression coil spring 73 mounted between the top of the enclosure 68 and the T-shaped actuating button 70. A cap 74 may be provided on the T-shaped actuating button 70.

Figure 2:
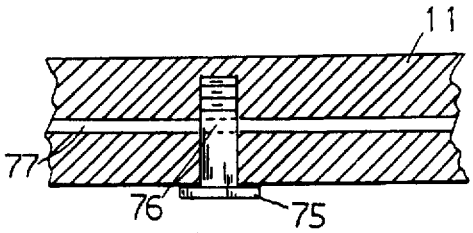
FIG. 2 is an isolated enlarged cross sectional top view of the pilot flame regulation means located at the channel to the pilot outlet port for controlling the operation of the pilot flame thereof.

As best shown in FIG. 2, an adjustment bolt 75 is rotatably mounted in the unit body 11 of the control device 11. The adjustment bolt 75 has a transverse through opening 76 therein which may be aligned with the pilot gas passage 77 formed in the unit body 11 by turning the adjustment bolt 75. The pilot gas passage 77 extends from the pilot chamber 13 to the pilot outlet port 18. In the OFF position, the adjustment bolt 75 is turned to the position in which the transverse through opening 76 therein is not aligned with the pilot gas passage 77 such that the pilot chamber 13 is not in communication with the pilot outlet port 18.

Figure 3:
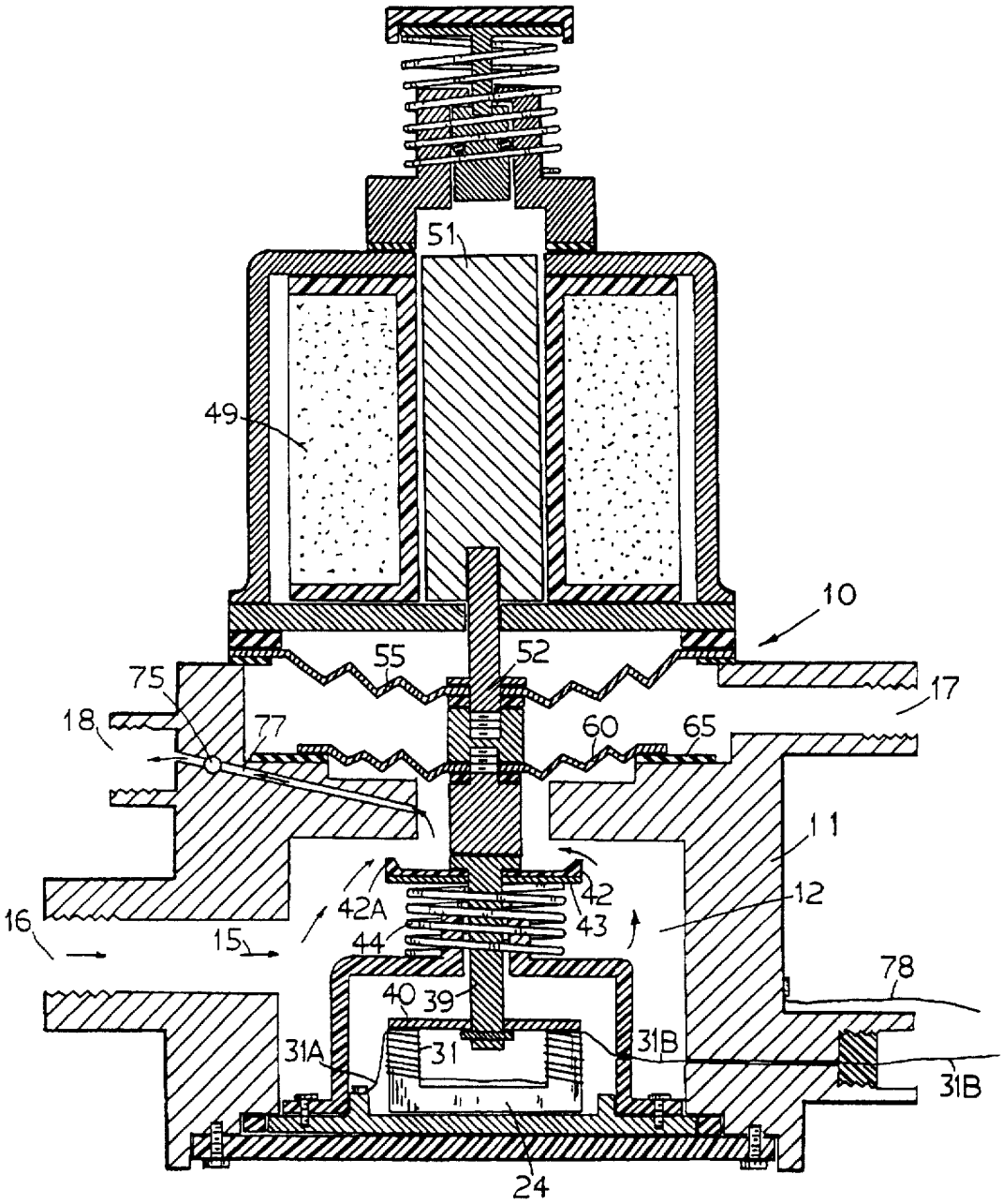
FIG. 3 is a general partial cross sectional side elevation view of the control valve in the PILOT condition thereof when gas is only flowing to the pilot burner as the latter is being ignited.

As shown in FIG. 3, to initiate the operation of the control device 10, the adjustment bolt 75 is turned to the open position with its transverse through opening 76 aligned with the pilot gas passage 77, and the solenoid 48 is actuated by passing a current to its windings 49. The plunger 51 will move to the lower position with the energisation of the solenoid 48, which causes the cross-shaped spacer 52 to move downwards against the biassing force of the spring diaphragm 55. The rim of the sealing diaphragm 60 will press tightly against the annular sealing gasket 65 located at the stepped shoulder 64 at the top of the pilot chamber 13 so as to close the communication between the pilot chamber 13 and the outlet chamber 14. In the meantime, the extender member 61 presses downwards on the T-shaped pin 39 so that the sealing plate 42 moves downwards against the biassing force of the compression spring 44 to open the passage opening 45 for allowing the combustion gas 15 from the main chamber 12 to pass through the passage opening 45 and the pilot gas passage 77 to the pilot outlet port 18 to the pilot burner. The pilot burner may then be ignited as in common practice with an electrical means or with a lighted match. At this initiation position, the magnetic plate 40 also moves to a lower position contacting with the upstanding arms of the U-shaped core 24.

After the pilot flame at the pilot burner is ignited, a current will be generated by the thermocouple located at the pilot flame as in the well known manner. The current flows to the thermocouple windings 31 of the U-shaped magnetic core 24 through the lead 31B and a second lead 78 conveniently connected to the unit body 11 of the control device 10 by securing screw 79. The electrical contact of lead 78 to the lead 31A of the thermocouple windings 31 securing to the post 30A of the support plate 23 by screw 34 is through the intimate contact between the unit body 11 with the support plate 23. The energisation of the thermocouple windings 31 with the current from the thermocouple located at the pilot flame also generates the electromagnetic force in the U-shaped magnetic core 24 to hold the magnetic plate 40 against the upstanding arms 25 and 26.

Figure 4:
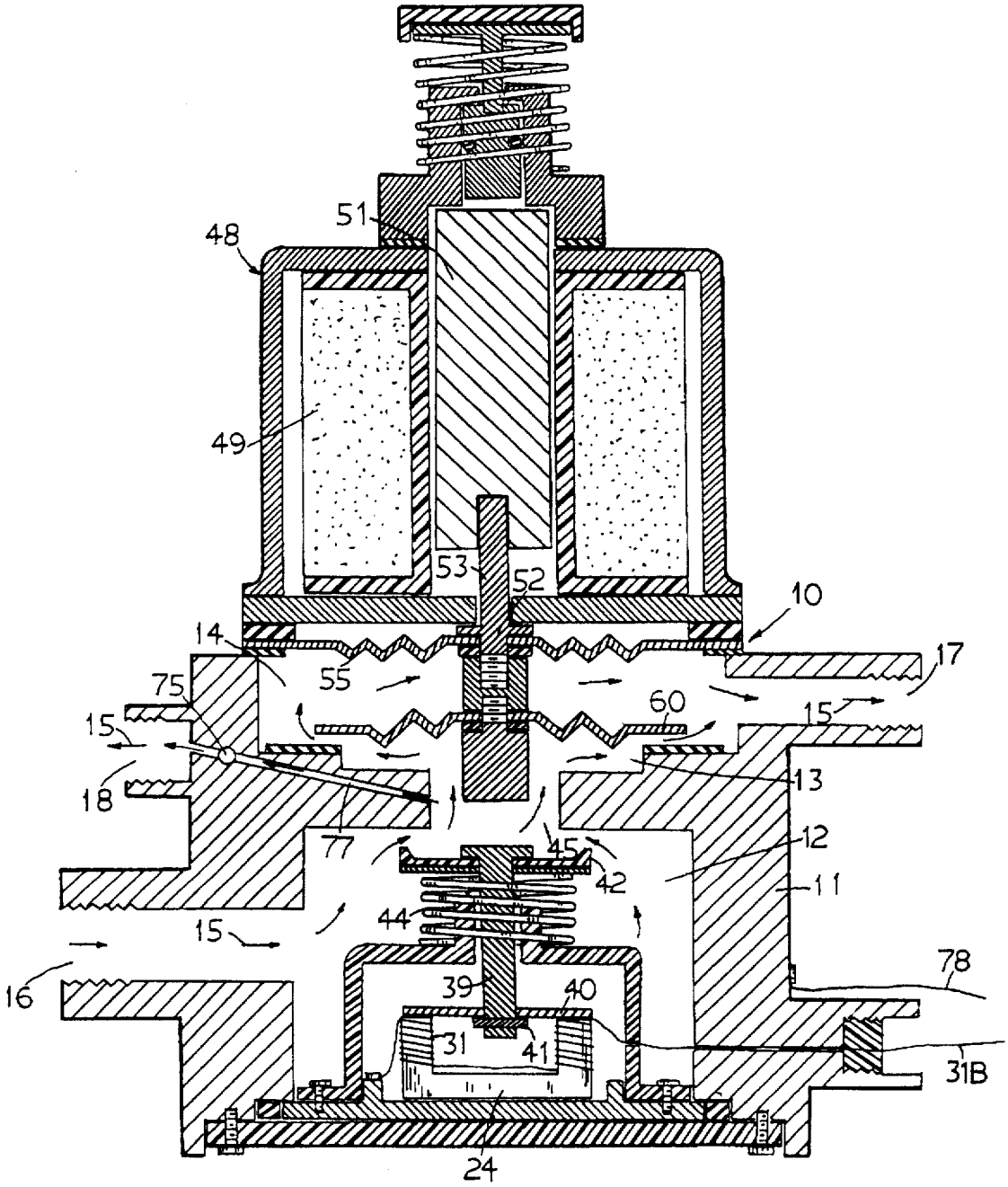
FIG. 4 is a general partial cross sectional side elevation view of the control valve in the ON condition thereof when gas is flowing to both the pilot burner and the main burner.

After the pilot flame is lighted, the solenoid 48 is de-energized to initiate the ON condition as best shown in FIG. 4. In this condition, the plunger 51 in the solenoid 48 and, in turn, the cross shaped spacer 52 return to their upper positions by the spring diaphragm 55. Also, the sealing diaphragm 60 retracts to its upper position to open the communication between the pilot chamber 13 and the outlet chamber 14. The passage opening 45 is maintained opened by the holding of the magnetic plate 40 onto the upstanding arms 25 and 26 of the magnetic core 24 with the electromagnetic force generated in the thermocouple windings 32 by the pilot flame. Thus, the combustion gas 15 entering the main chamber 12 to the pilot chamber 13 will also flow into the outlet chamber 14 to exit the outlet port 17 to the main burner to be ignited by the pilot flame.

The normal ON and OFF operations of the main burner may be effected by energizing or de-energizing the solenoid 48 by a conventional thermostatic termperature control or timer control so as to cause the sealing diaphragm 60 to close or open the communication between the pilot chamber 13 and outlet chamber 14 accordingly.

To terminate the operation of the control device 10, the solenoid 48 is de-energized, and the adjustment bolt 75 is turned to the shut off position with its through opening 76 therein out of alignment with the pilot gas passage 77. The shutting of the adjustment bolt 75 will extinguish the pilot flame so as to result in the termination of the current flowing to the thermocouple windings 31, and, in turn, the termination of the electromagnetic force which holds the magnetic plate 40 against the upstanding arms 25 and 26 of the magnetic core 24. With the removal of the electromagnetic force, the sealing plate 42 returns to its upper position to press tightly upwards to close the passage opening 45, thus the combustion gas 15 is prevented to flow to the pilot chamber 13 and outlet chamber 14 to result in the complete shut off of the control device 10. It can be appreciated by those skilled in the art that the above arrangement is particularly advantageous in that the windings 31 and the U-shaped magnetic core 24 remain stationary during all operations thus the windings 31 are not subject to breakage due to any movement. Furthermore, replacement and maintenance operation of the control valve assembly can be easily accomplished by removing the bottom cover 19.

The pilot flame may also be ignited alternatively or for service purposes, by first turning the adjustment bolt 75 to open the pilot gas passage 77 and then depressing the button 70 of the manual over-ride 66 and holding it at the depressed position. At this position, the plunger 51 will move downwards to cause the sealing diaphragm 60 and the sealing plate 42 to move to the lower positions as shown in FIG. 3 so as to allow the combustion gas 15 to flow to the pilot outlet port 18 to the pilot burner for igniting the pilot flame therein. After the pilot flame has been ignited the manual over-ride 66 may be released so that the control device 10 will be in the normal operating condition as shown in FIG. 4 with the magnetic plate 40 held against the upstanding arms 25 and 26 of the magnetic core 24 by the generation of the electromagnetic force therein by the current from the thermocouple flowing to the thermocouple windings 31 by the pilot flame. This manual over-ride operation may be terminated by turning the adjustment bolt 75 to the shut off position in which its through opening 76 is again not aligned with the pilot gas passage 77.

A sealing gasket 78 may be provided to ascertain that the joint between the over-ride and the solenoid is air tight and is securedly formed.

Various modifications can be made without departing from the spirit of this invention or the scope of the appended claims. In view of the above, it will be seen that several objects of the invention are achieved and other advantages are obtained. As many changes could be made in the above construction and methods without departing from the scope of the invention, it is intended that all matter contained in the above description shall be interpreted as illustrative and not in a limiting sense.

What is claimed is:

1. A control device for controlling gas supply to a main burner and a pilot burner of a combustion gas burning equipment, comprising a unit body having a main chamber, a pilot chamber and an outlet chamber, said main chamber having an inlet port operative to admit the combustion gas therein, said pilot chamber having a pilot outlet port operative to supply said gas to said pilot burner, said outlet chamber having a main outlet port operative to supply said gas to said main burner, a passage opening located between said pilot chamber and said main chamber, a sealing plate member mounted on a retaining pin disposed in said main chamber, said sealing plate member being biassed by a spring means to press normally against said passage opening, a magnetic plate member mounted on another end of said retaining pin, a magnetic core member disposed in said main chamber, said magnetic core member having electrical windings provided thereon, and said electrical windings being electrically connected to a thermocouple located at said pilot burner, said magnetic plate member being normally located in a spaced manner from said magnetic core member, a sealing diaphragm member located in said outlet chamber, and operative to close the communication between said pilot chamber and said outlet chamber, a solenoid means disposed on said unit body, said solenoid means having a plunger member slidably mounted therein, said solenoid being operative to move said plunger member slidably to an upper position and a lower position selectively within said solenoid means, a spacer member coupled to said plunger member, said spacer member having a free end extending into said outlet chamber, said sealing diaphragm member being mounted on said spacer member, a pilot gas passage formed in said unit body, said pilot gas passage extending from said pilot chamber to said pilot outlet port, an adjustment bolt member disposed in said unit body, said adjustment bolt member having a transverse through opening formed therein, said adjustment bolt member being operative to align said transverse through opening selectively with said pilot gas passage.

2. A control device according to claim 1 including a spring diaphragm member mounted to said spacer member, said spring diaphragm member normally maintaining said sealing diaphragm member to position in a spaced manner from a stepped shoulder portion of said pilot chamber to allow communication between said pilot chamber and said outlet chamber.

3. A control device according to claim 2 including a sealing gasket disposed on said stepped shoulder portion of said pilot chamber, and operative to engage with a rim portion of said sealing diaphragm member when said sealing diaphragm member is located in a lower position pressing on said stepped shoulder portion.

4. A control device according to claim 3 wherein said solenoid means is an electrical solenoid having electrical windings provided on a bobbin located therein.

5. A control device according to claim 4 wherein said magnetic plate member and said magnetic core member are located in a secondary enclosure located within said main chamber, said sealing plate member being biassed by a compression coil spring member located between said sealing plate member and said secondary enclosure to maintain said sealing plate member from pressing tightly against said passage opening for closing said passage opening.

6. A control device according to claim 5 wherein said main chamber has a bottom opening covered by a bottom cover, and said secondary enclosure is mounted on an electrically conductive plate secured on said bottom cover.

7. A control device according to claim 6 wherein said electrically conductive plate is in electrical contact with said unit body, and one lead of said electrical windings on said magnetic core member is connected to said electrical conductive plate, a second lead of said electrical windings extending outside of said unit body for direct electrical connection to one terminal of said thermocouple located at said pilot burner.

8. A control device according to claim 7 wherein said sealing diaphragm member includes an upstanding ridge formed on a rim portion therein.

9. A control device according to claim 8 including a manual override arrangement mounted on said solenoid means, said over-ride arrangement having a shaft member slidably mounted therein and operative selectively to move said plunger member in said solenoid to said lower position.

10. A control device for controlling gas supply to a main burner and a pilot burner of a combustion gas burning equipment, comprising a unit body having a main chamber, a pilot chamber and an outlet chamber, said main chamber having an inlet port operative to admit the combustion gas therein, said pilot chamber having a pilot outlet port operative to supply said gas to said pilot burner, and outlet chamber having a main outlet port operative to supply said gas to said main burner, a passage opening located between said pilot chamber and said main chamber, and a stepped shoulder portion formed in the top portion of said passage opening, an electrical solenoid mounted on said unit body, said electrical solenoid having electrically energisable windings provided on a bobbin located therein, and a plunger member slidably located within said bobbin, a cross shaped spacer member having an elongated upper leg portion connected to said plunger member, and a lower portion located in said outlet chamber, a spring diaphragm member mounted on said lower portion of said cross shaped spacer member, said spring diaphragm member maintaining said plunger member in said upper position, a sealing diaphragm member mounted on said lower portion of cross shaped spacer member, said sealing diaphragm member normally located in a spaced manner from said stepped shoulder portion of said passage opening, and having a diameter larger than the diameter of said stepped shoulder portion, a magnetic core member disposed in a secondary enclosure located in said main chamber, and having windings of a thermocouple wire provided thereon, said secondary enclosure being mounted on an electrically conductive plate having an intimate electrical contact with said unit body, one lead of said thermocouple wire being connected to said conductive plate, and another lead of said thermocouple wire extending through said unit body outside of said device for electrical connection with a thermocouple located at said pilot burner, a retaining pin member slidably mounted through a top opening of said secondary enclosure, said retaining pin having a lower end extending in said secondary enclosure, a magnetic plate member mounted on said lower end of said retaining pin member, a sealing plate member mounted in a top portion of said retaining pin member, a compression coil spring disposed between said sealing plate member and said secondary enclosure, said compression coil spring maintaining said magnetic plate member to locate normally in a spaced manner above said magnetic core member, and said sealing plate member tightly pressing against said passage opening.

11. A control device according to claim 10 including an extender member mounted at the lower end of said space member and extending into said pilot chamber below said sealing diaphragm member, the lower end of said extender member normally located in a spaced manner from the top of said retaining pin member.

12. A control device according to claim 11 including a sealing gasket mounted on said stepped shoulder portion, said sealing gasket being operative to engage with the rim portion of said sealing diaphragm member to provide a air tight seal.

13. A control device according to claim 12 wherein said sealing diaphragm member includes an upstanding ridge formed in the rim portion therein.

14. A control device according to claim 13 wherein said main chamber has a bottom opening covered by a bottom cover secured to said unit body, said electrically conductive plate being mounted on said bottom cover.

15. A control device according to claim 14 including a manual over-ride arrangement mounted on said solenoid, said over-ride arrangement having a shaft member slidably mounted in a protective enclosure and operative selectively to move said plunger member in said solenoid to said lower position.

16. A control device according to claim 15 including a T-shaped actuating button slidably extending through said protective enclosure and mounted to said shaft member, said button being operative selectively to press said plunger member in said solenoid to said lower position.

17. A control device according to claim 16 including a second compression coil spring disposed between said secondary enclosure and said T-shaped actuating button, said second compression coil spring maintaining said shaft member in a raised position spaced from said plunger member.

18. A control device according to claim 17 including a support plate disposed beneath said sealing plate member and located between said sealing plate member and second compression coil spring.

19. A control device according to claim 18 including a sealing oring mounted on said shaft member and a cap mounted on top of said actuating button.

20. A control device according to claim 19 wherein said magnetic ocre member is U-shaped member fixedly mounted within said secondary enclosure and having two upstanding arms, and said windings of thermocouple wire are wound on said upstanding arms, and said magnetic plate member is normally located in a spaced manner above the top of said upstanding arms.

* * * * *